US006393807B2

(12) United States Patent
Tipton et al.

(10) Patent No.: US 6,393,807 B2
(45) Date of Patent: May 28, 2002

(54) INSULATION STRAPPING MACHINE

(75) Inventors: Allison Dudley Tipton, Bloomingdale; Rainer Ropers, Lake Zurich; James Roberts, Des Plaines, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 31 days.

(21) Appl. No.: 09/758,358

(22) Filed: Jan. 12, 2001

Related U.S. Application Data

(62) Division of application No. 09/409,009, filed on Sep. 29, 1999.

(51) Int. Cl.[7] ..... B65B 13/08; B65B 13/20

(52) U.S. Cl. ..... 53/504; 53/529; 53/589; 100/3

(58) Field of Search ..... 53/201, 529, 504, 53/889; 100/3, 26, 48, 232, 264; 198/345.1, 345.3

(56) References Cited

U.S. PATENT DOCUMENTS 2,749,837 A * 6/1956 Hayford ..... 100/232
2,818,795 A * 1/1958 Gustafson ..... 53/589
2,966,816 A * 1/1961 White ..... 100/3
3,017,730 A * 1/1962 Rodish ..... 53/529
3,590,731 A * 7/1971 Nichols ..... 100/232
3,735,555 A * 5/1973 Pasic ..... 53/529
4,356,763 A * 11/1982 Hagstrom ..... 100/48
4,524,582 A * 6/1985 Lucas ..... 100/48
4,622,893 A * 11/1986 Magoni ..... 53/589
5,168,976 A * 12/1992 Kettleson ..... 198/345

* cited by examiner

*Primary Examiner*—John Sipos
(74) *Attorney, Agent, or Firm*—Schwartz & Weinrieb

(57) ABSTRACT

An insulation strapping machine comprises a vertically reciprocable platen and horizontally reciprocable opposed pairs of compressors which are able to have their relative positions adjustably controlled such that the platen and compressors cooperate together so as to form or define a variably sized package cavity within which the variously different or different sized articles, packages, or materials to be strapped can be disposed for properly achieving a strapping or packaging operation. A vertically movable package stop is incorporated within the package cavity conveyor system so as to predeterminedly longitudinally center articles, packages, or materials of various different length dimensions within the package cavity, and each one of the package compressors can develop 10,000 pounds of compressive force so as to achieve a predetermined amount of compression with respect to certain insulation materials. Still further, the articles, packages, or materials may be strapped or packaged in accordance with different strapping modes, depending upon, for example, the particular packages, articles, or materials being strapped or packaged as well as the compression levels impressed upon such packages, articles, or materials, whereby failure of the packaged or strapped articles, packages, or materials is effectively prevented.

21 Claims, 11 Drawing Sheets

18

LOAD SETTINGS SCREEN

AUTOMATIC SCREEN

Identification of Load Settings.
Touch Function Key for new Settings;
or Touch Select Auto Setup to insert New Load Setting Parameters

MANUAL SCREEN

Default Screen with power On

INSULATION STRAPPING MACHINE

This patent application is a Divisional patent application of prior U.S. patent application Ser. No. 09/409,009, which was filed on Sep. 29. 1999.

FIELD OF THE INVENTION

The present invention relates generally to strapping machines, and more particularly to a new and improved strapping machine which is particularly adapted for strapping either standard insulation products or duct wrap insulation materials, and wherein the different materials may also have differently sized dimensions.

BACKGROUND OF THE INVENTION

Strapping machines for strapping various articles or loads are of course well known and conventionally comprise, for example, a horizontally disposed conveyor for infeeding and supporting articles to be strapped, pairs of opposed compressors for compressing the articles prior to the strapping of the same with suitable strapping materials, and strapping heads for applying the strapping materials to the compressed articles while the articles are maintained in their compressed state by means of the opposed pairs of compressors. While such conventional strapping machines have of course performed satisfactorily, such conventional machines have various operational limitations, and in addition, they are not readily capable of handling or applying strapping to different types of articles, packages, or materials to be strapped, they are not readily capable of handling or applying strapping to different sized articles, packages, or materials to be strapped, and they are not readily capable of strapping different types of articles, packages, or materials to be strapped in accordance with different types of strapping modes.

For example, different materials exhibit different density parameters or characteristics, and therefore, in order to efficiently or compactly achieve the packaging or strapping of different types of articles, packages, or materials, a predeterminedly different amount of compression force is necessarily required to be impressed upon the different articles, packages, or materials, however, conventional strapping machines are not necessarily capable of achieving certain predetermined compression force levels as may be required.

In addition, when operatively packaging or strapping a multitude of different articles, packages, or materials, such articles, packages, or materials will of course be of various sizes, and more particularly, have variously different length dimensions. It is therefore important to effectively center the articles, packages, or materials, in a lengthwise manner, with respect to the strapping heads of the strapping machine such that the strapping members can in fact be placed or positioned around the articles, packages, or materials in a symmetrical manner with respect to the longitudinal center of the articles, packages, or materials in order to ensure that the articles, packages, or materials are properly or securely strapped or packaged. However, conventional strapping or packaging machines are not readily capable of longitudinally centering the articles, packages, or materials. More particularly, such longitudinal centering of the articles, packages, or materials are achieved by such conventional machines by elevating a package stop member in an inclined manner on a trial and error manner, however, as may be readily appreciated, this process is quite inefficient, time-consuming, and therefore not desirable from a production point of view.

Still further, when applying strapping members to the variously different articles, packages, or materials, it is sometimes desirable to achieve different compression levels to particular articles, packages, or materials in order to achieve different predetermined degrees of compactness for such articles, packages, or materials. Such different compression levels or degrees of compactness may then require, however, that the articles, packages, or materials be strapped or packaged in different modes or manners in order to ensure that the articles, packages, or materials remain securely and safely strapped or packaged. Conventionally available strapping or packaging machines, however, are not readily capable of achieving such different strapping or packaging modes such that when certain packages, articles, or materials are strapped or packaged to predetermined compression levels so as to achieve the desired predetermined degrees of compactness, the strapping members, and in effect, the articles, packages, or materials per se, experience or exhibit failure which is of course undesirable.

A need therefore exists in the art for a new and improved strapping machine which is particularly adapted for use in connection with the strapping or packaging of insulation materials wherein such strapping machines would be readily capable of handling or applying strapping to different types of articles, packages, or materials to be strapped, wherein such strapping machines would be readily capable of handling or applying strapping to different sized articles, packages, or materials to be strapped, and wherein such strapping machines would be readily capable of strapping different types of articles, packages, or materials to be strapped in accordance with different types of strapping modes.

OBJECTS OF THE INVENTION

Accordingly, it is an object of the present invention to provide a new and improved strapping machine.

Another object of the present invention is to provide a new and improved strapping machine which is particularly adapted for strapping or packaging various different types of insulation materials.

An additional object of the present invention is to provide a new and improved strapping machine which is particularly adapted for strapping or packaging various different types of insulation materials and which is particularly adapted for overcoming the various aforenoted drawbacks or operative disadvantages characteristic of PRIOR ART insulation strapping machines.

A further object of the present invention is to provide a new and improved insulation strapping machine which is particularly adapted for strapping or packaging various different types of insulation materials wherein such strapping machines would be readily capable of handling or applying strapping to different types of articles, packages, or materials to be strapped, wherein such strapping machines would be readily capable of handling or applying strapping to different sized articles, packages, or materials to be strapped, and wherein such strapping machines would be readily capable of strapping different types of articles, packages, or materials to be strapped in accordance with different types of strapping modes.

SUMMARY OF THE INVENTION

The foregoing and other objectives are achieved in accordance with the teachings and principles of the present invention through the provision of a new and improved insulation strapping machine which comprises a vertically reciprocable platen and horizontally reciprocable opposed pairs of compressors which are able to have their relative positions adjustably controlled such that the platen and compressors cooperate together so as to form or define a variably sized package cavity within which the variously different or different sized articles, packages, or materials to be strapped can be disposed for properly achieving a strapping or packaging operation. A vertically movable package stop is incorporated within the package cavity conveyor system so as to predeterminedly longitudinally center articles, packages, or materials of various different length dimensions within the package cavity, and each one of the package compressors can develop 10,000 pounds of compressive force so as to achieve a predetermined amount of compression with respect to certain insulation materials. Still further, the articles, packages, or materials may be strapped or packaged in accordance with different strapping modes, depending upon, for example, the particular packages, articles, or materials being strapped or packaged as well as the compression levels impressed upon such packages, articles, or materials, whereby failure of the packaged or strapped articles, packages, or materials is effectively prevented.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
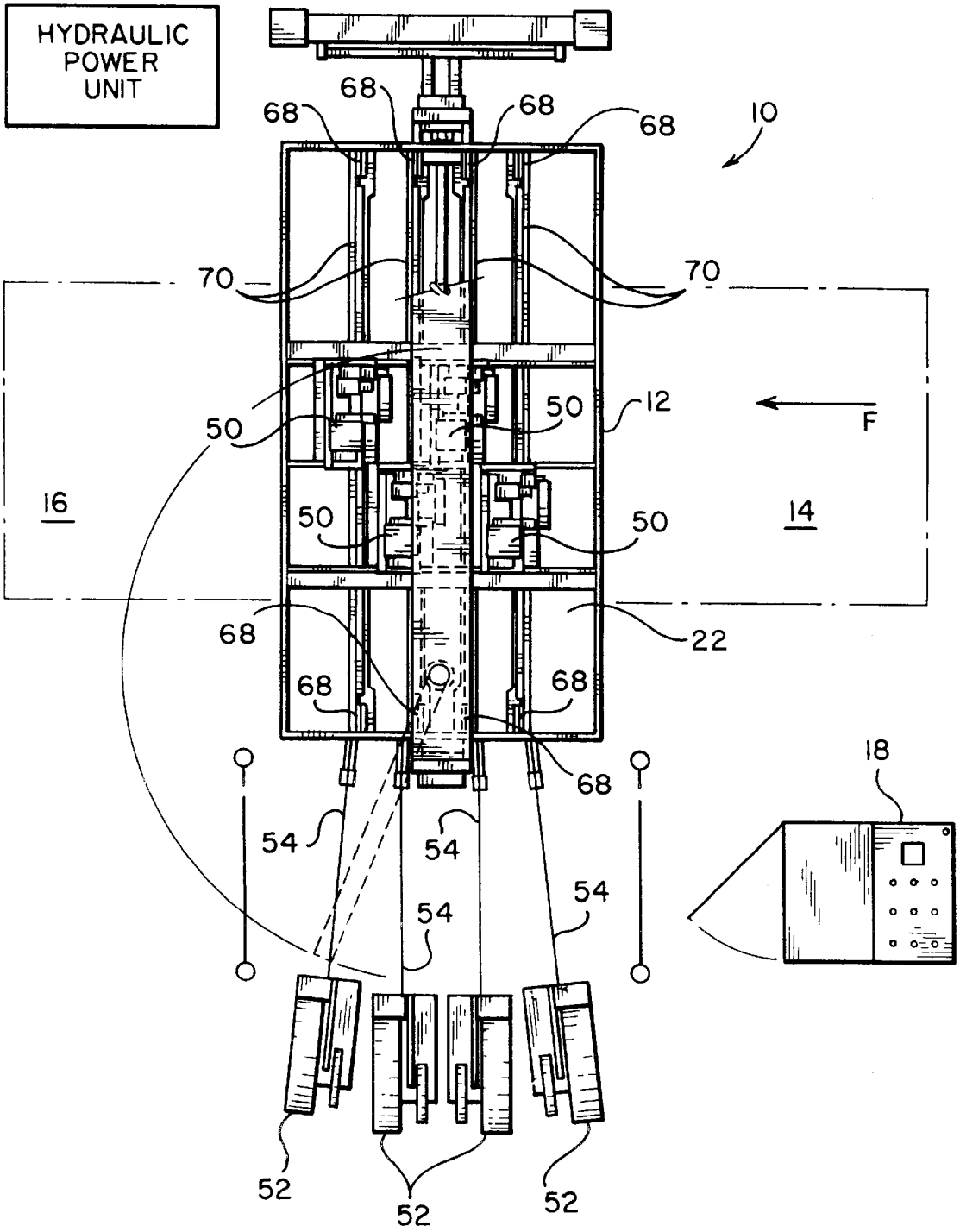
FIG. 1 is a top plan view of a first embodiment of a new and improved insulation strapping machine or system which has been constructed in accordance with the teachings and principles of the present invention.

Referring now to the drawings, and more particularly to FIG. 1 thereof, a first embodiment of a new and improved insulation strapping machine or system which has been constructed in accordance with the teachings and principles of the present invention is disclosed and is generally indicated by the reference character 10. In accordance with this first embodiment of the insulation strapping machine or system 10, it is noted that a strapping or packaging station is provided or formed at 12, and operatively associated with the strapping or packaging station 12 there is provided an infeed or entry conveyor 14 for infeeding articles, packages, or materials to be strapped or packaged, and a discharge or exit conveyor 16 for removing articles, packages, or materials which have been strapped or packaged whereby the flow direction of the articles, packages, or materials to be strapped or packaged is from right to left and is denoted by the arrow F. An operator control console, from which the insulation strapping or packagine machine or system 10 can be controlled, is disclosed at 18 and is seen to be disposed adjacent to or within the nearby vicinity of the entry or infeed conveyor 14 and the strapping or packaging station 12.

Figure 2:
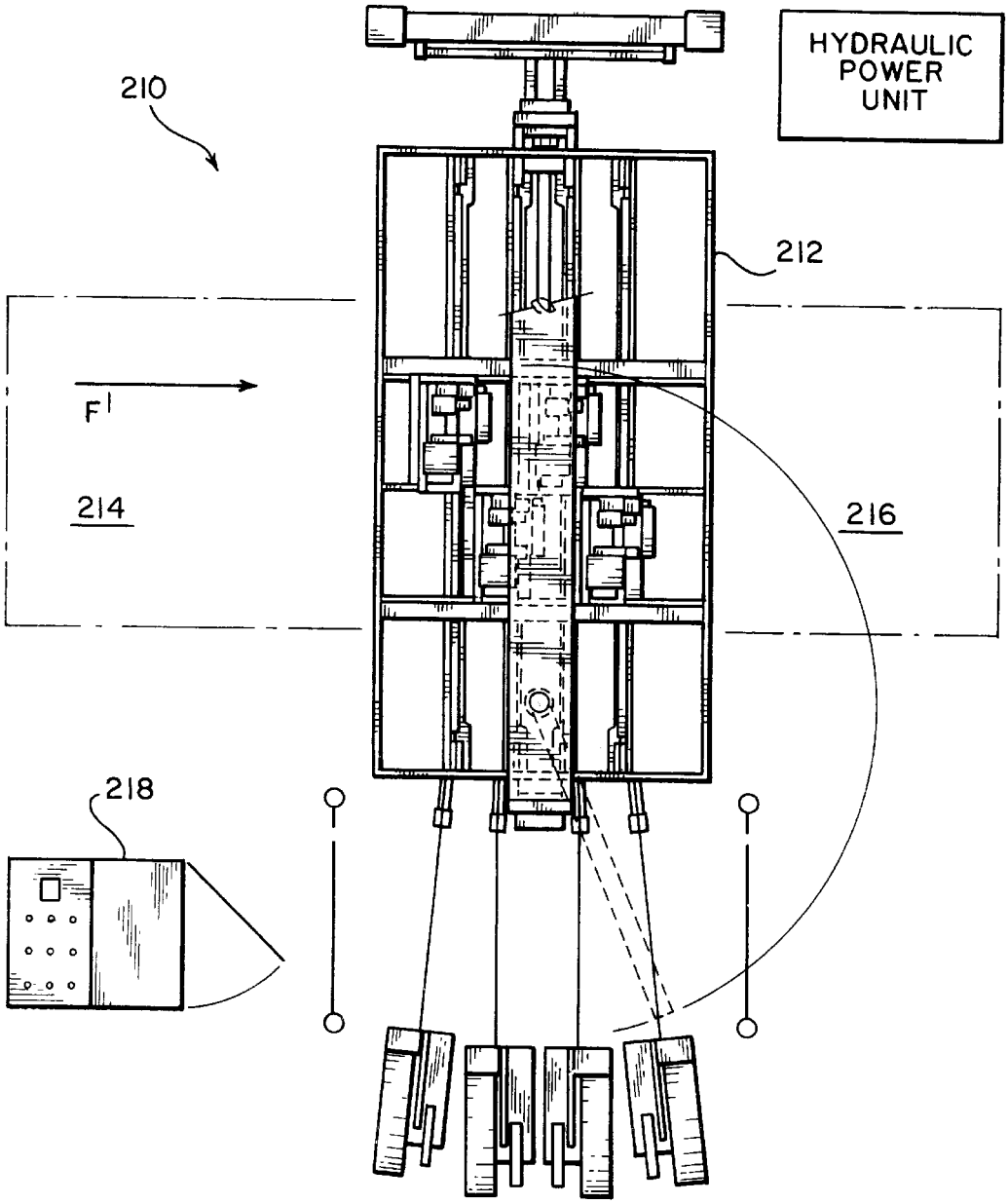
FIG. 2 is a top plan view, similar to that of FIG. 1, showing however a second embodiment of a new and improved insulation strapping machine or system which has been constructed in accordance with the teachings and principles of the present invention and wherein the machine or system embodiment of FIG. 2 is effectively a mirror image of the machine or system embodiment of FIG. 1.

With additional reference being made to FIG. 2, a second embodiment of a new and improved insulation strapping machine or system which has also been constructed in accordance with the principles and teachings of the present invention is disclosed and is generally indicated by the reference character 210. It is to be noted that in accordance with this second embodiment of the insulation packaging or strapping machine or system 210, this second embodiment of the insulation strapping or packaging machine or system 210 is substantially the same as the first embodiment of the insulation strapping or packaging machine or system 10 shown in FIG. 1 except that the direction of flow of the articles, packages, or materials to be strapped or packaged is from left to right as denoted by the arrow F' and the operator console 218 is disposed upon the left side of the strapping or packaging station 212 so as to be disposed adjacent to the infeed or entry conveyor 214. Accordingly, the insulation strapping or packaging machine or system of the present invention can in effect embody either one of the embodiments 10 or 210 depending upon the available layout space for the machine or system 10,210 within the particular production facility. It is also noted that while all further description of the insulation strapping machine or system will be in connection with the first embodiment disclosed within FIG. 1, such description is equally applicable to the second embodiment disclosed within FIG. 2, and parts of the second embodiment disclosed within FIG. 2 which correspond to similar parts of the first embodiment disclosed within FIG. 1 have been designated by similar reference characters within the 200 series.

Figure 3:
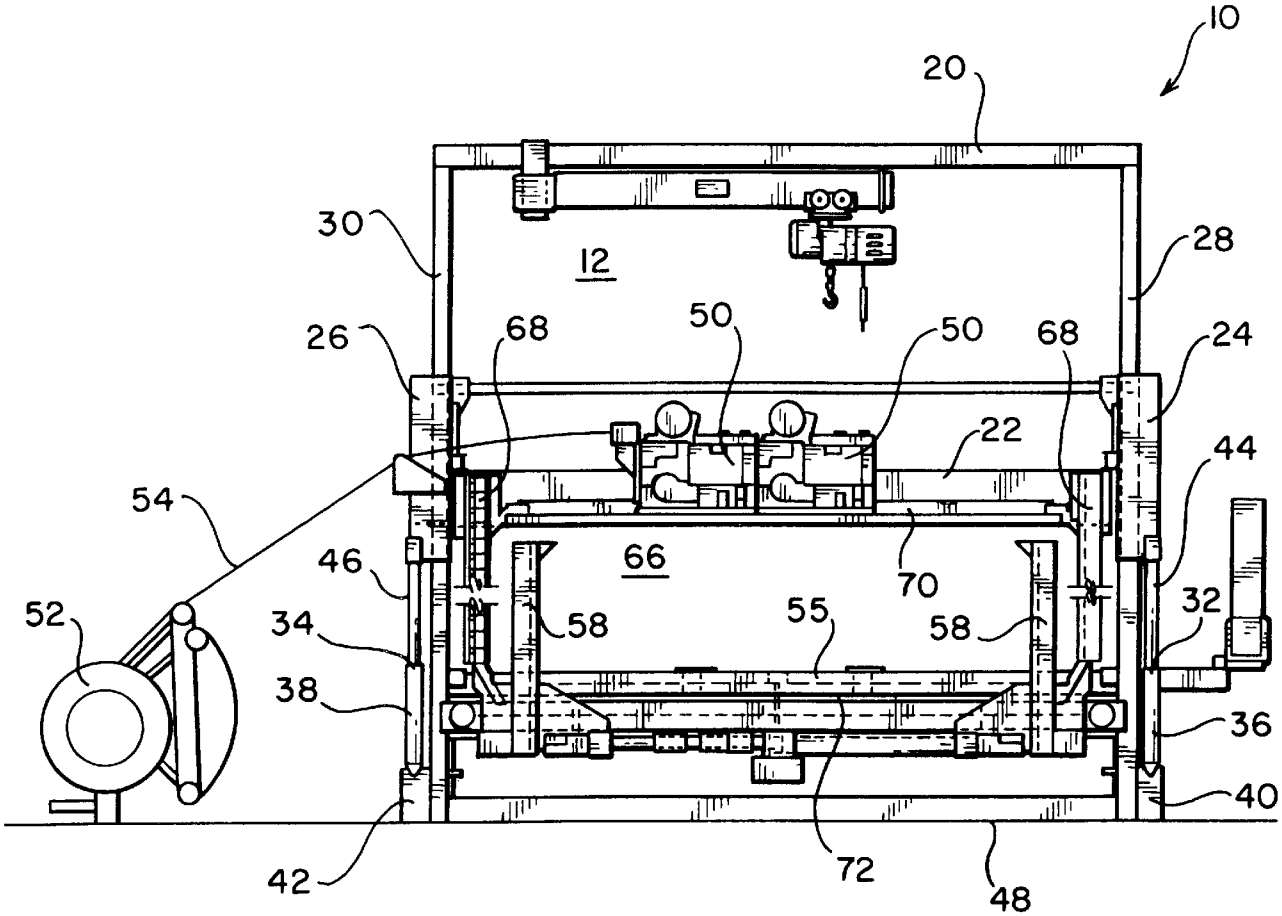
FIG. 3 is a side elevation view of the insulation strapping machine or system disclosed within FIG. 1.

With particular reference now being made to FIGS. 1 and 3, the insulation strapping or packaging machine 10 is seen to comprise a main framework 20 upon which a vertically reciprocable platen 22 is movably mounted. More particularly, opposite ends of the platen 22 are fixedly mounted upon platen support frames 24,26 which are slidably disposed upon fixed upstanding masts 28,30 which are located at opposite ends of the main framework 20. Platen 22 is adapted to be driven in the upward direction by means of a pair of hydraulic cylinder assemblies 32,34, however, the platen 22 is permitted to move downwardly under gravitational forces, all in accordance with a hydraulic control circuit which will be briefly discussed hereinafter. The cylinder members 36,38 of the hydraulic cylinder assemblies 32,34 are operatively connected to and supported upon upstanding stanchions 40,42, while the piston rods 44,46 of the hydraulic cylinder assemblies 32,34 are operatively connected to the platen support frames 24,26. The upstanding support stanchions 40, 42 are of course suitably affixed, such as, for example, by suitable bolt fasteners, to the region of the facility floor 48 which effectively defines the bottom of the strapping or packaging station 12.

A plurality of strapping heads, such as, for example four strapping heads 50,50,50,50, are fixedly mounted upon the platen 22, and a corresponding number of strap dispenser mechanisms 52,52,52,52 are mounted upon the facility floor 48 at the operator console end of the machine or system 10 so as to respectively provide strapping members or material 54,54,54,54 to the strapping heads 50,50,50,50. The strapping heads 50,50,50,50 are of course adapted to secure the strapping material or members 54,54,54,54 around the articles, packages, or materials which are deposited or fed into the strapping or packaging station 12 by means of the infeed or entry conveyor 14, and the strapping or packaging station 12 also comprises a roller conveyor assembly 55 comprising a plurality of conveyor rollers 56, as best seen in FIG. 6, upon which the articles, packages, or materials to be strapped or packaged are supported while such articles, packages, or materials are being strapped or packaged with the strapping materials or members 54,54,54,54 by means of the strapping heads 50,50,50,50.

In order to properly achieve the strapping or packaging of the particular articles, packages, or materials at the strapping or packaging station 12 by means of the strapping heads 50,50,50,50, a plurality of longitudinally movable, transversely spaced package, article, or material compressors 58,58,60,60,60,60,60,60,62,62 are disposed in opposed sets or pairs which are disposed upon opposite sides of the centerline 64 of the roller conveyor assembly 55 and adjacent opposite ends of the roller conveyor assembly 55. The longitudinally movable compressors 58–62 operatively cooperate with the vertically movable platen 22 so as to in effect define a machine package cavity 66 within which the articles, packages, or materials to be strapped or packaged are disposed or confined during strapping or packaging operations, and as will be explained more fully hereinafter, the longitudinally movable compressors 58–62 are moved longitudinally inwardly toward each other so as to compress the articles, packages, or materials to a predetermined degree whereupon, while the articles, packages, or materials are disposed in their compressed state, the strapping heads 50, 50,50,50 can be activated so as to secure strapping materials or members 54,54,54,54 around the compressed articles, packages, or materials.

Figure 6:
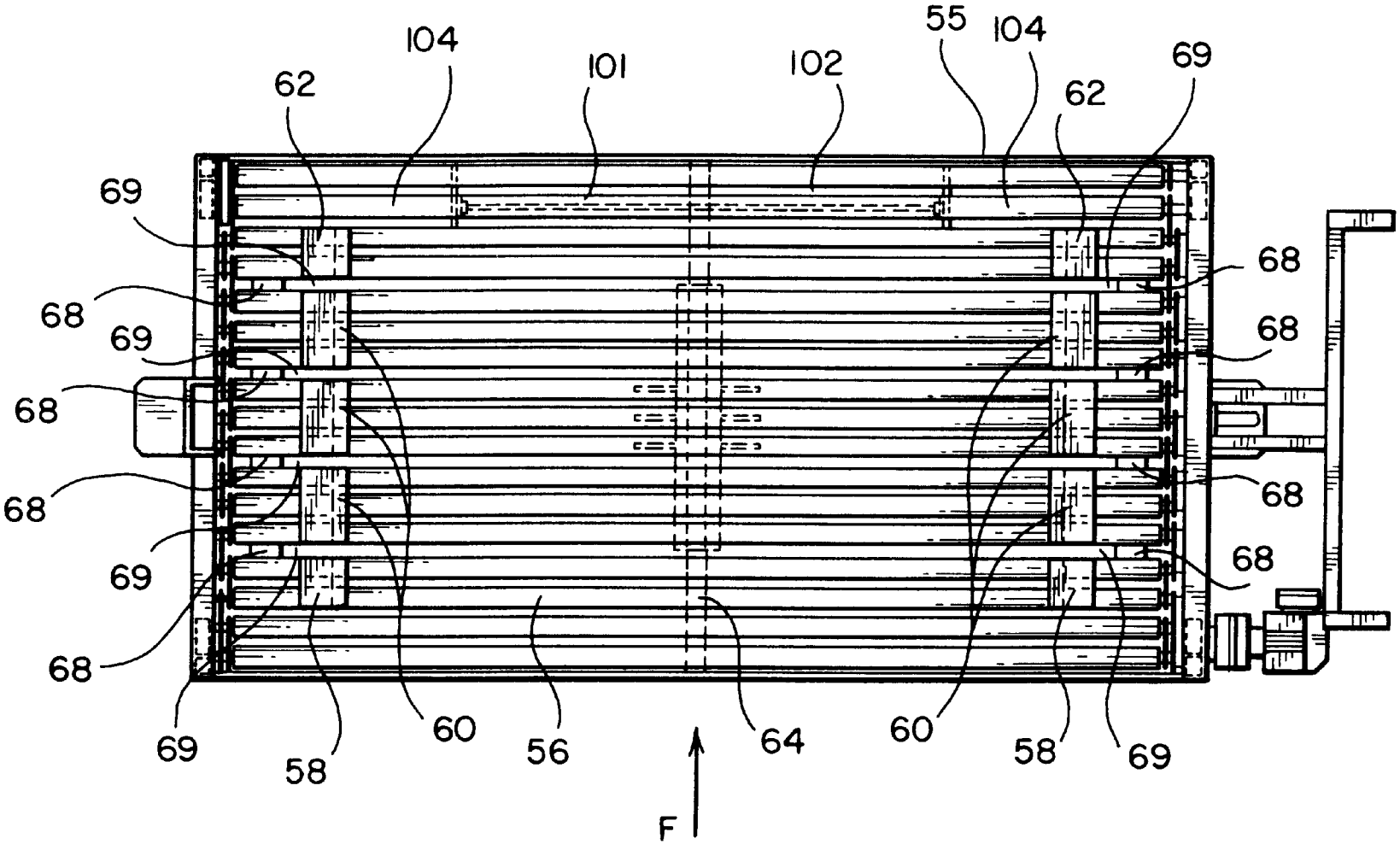
FIG. 6 is a top plan view of the roller conveyor assembly disposed at the strapping or packaging station of the insulation strapping machine or system as disclosed, for example, within FIG. 1.

In order to achieve, in effect, the circumferential disposition of the strapping materials or members 54, 54,54,54 around the compressed articles, packages, or materials disposed at the strapping or packaging station 12, eight vertical chute members 68 are arranged in oppositely disposed pairs or sets and project upwardly above the roller conveyor assembly 55 as best seen in FIG. 3 and as can also be appreciated from FIGS. 1 and 6. The vertical chute members 68 are disposed more remote from the centerline 64 of the roller conveyor assembly 55 than the longitudinally movable compressors 58–62 and are transversely spaced so as to in effect be transversely aligned with spaces 69 defined between adjacent ones of the compressors 58–62. In this manner, the vertical chute members 68 are able to be longitudinally aligned with four horizontally disposed, longitudinally extending chute members 70 which are defined upon the platen 22, as best seen in FIGS. 1 and 3, as well as four longitudinally extending chute members 72 provided or defined beneath the roller conveyor assembly 55 as best seen in FIG. 3. It may thus be appreciated that the horizontally disposed chute members 70 provided upon the platen 22, the vertically disposed chute members 68, and the horizontally disposed chute members 72 define substantially continuous circuitous conduits which encircle the articles, packages, or materials to be strapped or packaged at the strapping or packaging station 12 so as to guide the strapping materials or members 54 such that the strapping materials or members 54 can be properly secured around the packages, article, or materials to be strapped or packaged.

Figure 8:
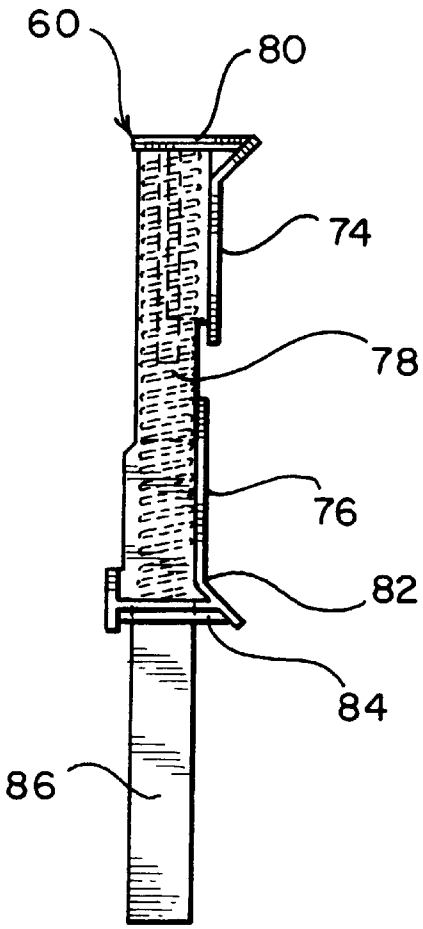
FIG. 8 is a side elevation view of the article, package, or material compressor assembly as shown in FIG. 7.
Figure 7:
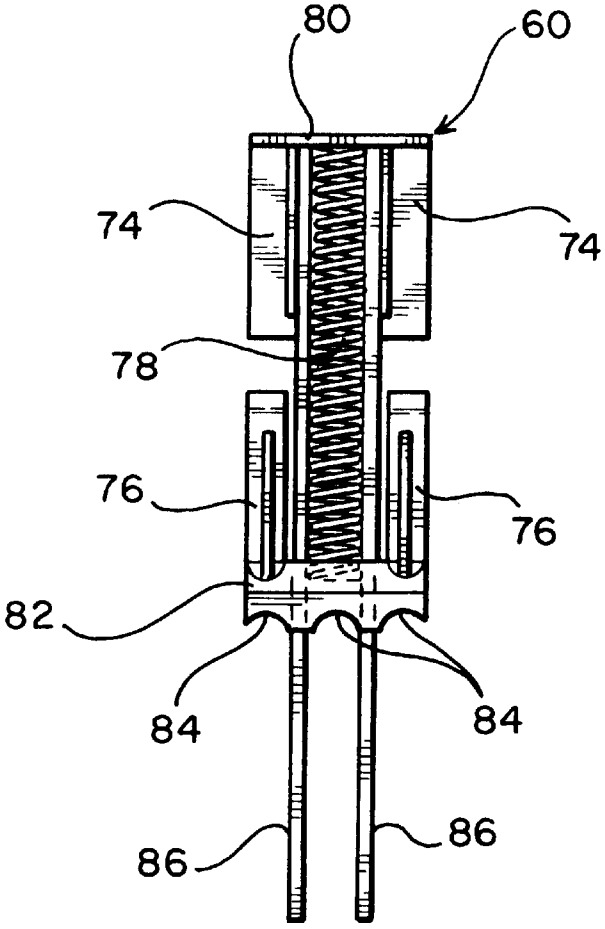
FIG. 7 is a front elevation view of a typical article, package, or material compressor assembly which is utilized within the insulation strapping machine or system of the present invention as disclosed within FIG. 1.

With reference now being made to FIGS. 7 and 8, further details of the longitudinally movable compressors will become further apparent, although for purposes of the discussion herein, and as explained hereinafter, only a description of the compressors 60 will be provided. It is initially noted, for example, that each one of the compressors 60 comprises a pair of transversely spaced upper sections 74,74 and a pair of transversely spaced lower sections 76,76 wherein the upper and lower sections 74,74,76,76 are adapted to be telescopically vertically movable with respect to each other such that the entire vertical extent of each compressor 60 can be operationally varied as will become more apparent hereinafter.

More particularly, the upper compressor sections 74,74 are vertically movable with respect to the lower compressor sections 76,76, and in order to achieve such telescopic or relative movement of the upper compressor sections 74,74 with respect to the lower compressor sections 76,76, a coil spring mechanism 78 is disposed within respective spaces defined between the transversely spaced upper sections 74,74 and the transversely spaced lower sections 76,76. A first end of the coil spring mechanism 78 is in abutment with an upper frame member 80, which fixedly interconnects the upper end portions of the upper compressor sections 74, 74, and a second opposite end of the coil spring mechanism 78 is in abutment with a lower frame member 82 which fixedly interconnects the lower end portions of the lower compressor sections 76,76. In this manner, the upper compressor sections 74,74 are normally biased away from the lower compressor sections 76,76 whereby each one of the compressors 60 is normally disposed or extended to its full vertical extent or state. The compressors 58–62 are thus adapted to be vertically telescopically compressed by means of the platen 22 when the platen 22 is lowered so as to cooperate with the platen 22 in defining the aforenoted machine package cavity 66.

With continued reference being made to FIGS. 7 and 8, it is further appreciated that the lower frame member 82 is provided with three transversely spaced semi-circular shaped grooves or arcuate portions 84 as a result of which each one of the compressors 60 is adapted to be movably and supportably mounted upon upper surface portions of three, individual, adjacent ones of the conveyor rollers 56. The semi-circular or arcuate shaped portions 84 of the compressors 60 are also formed from a suitable bearing material, such as, for example, ultra-high molecular weight polyethylene (UHMWPE), so as to facilitate the relative sliding movement of the compressors 60 with respect to and upon the upper surface portions of the conveyor rollers 56.

Figure 9:
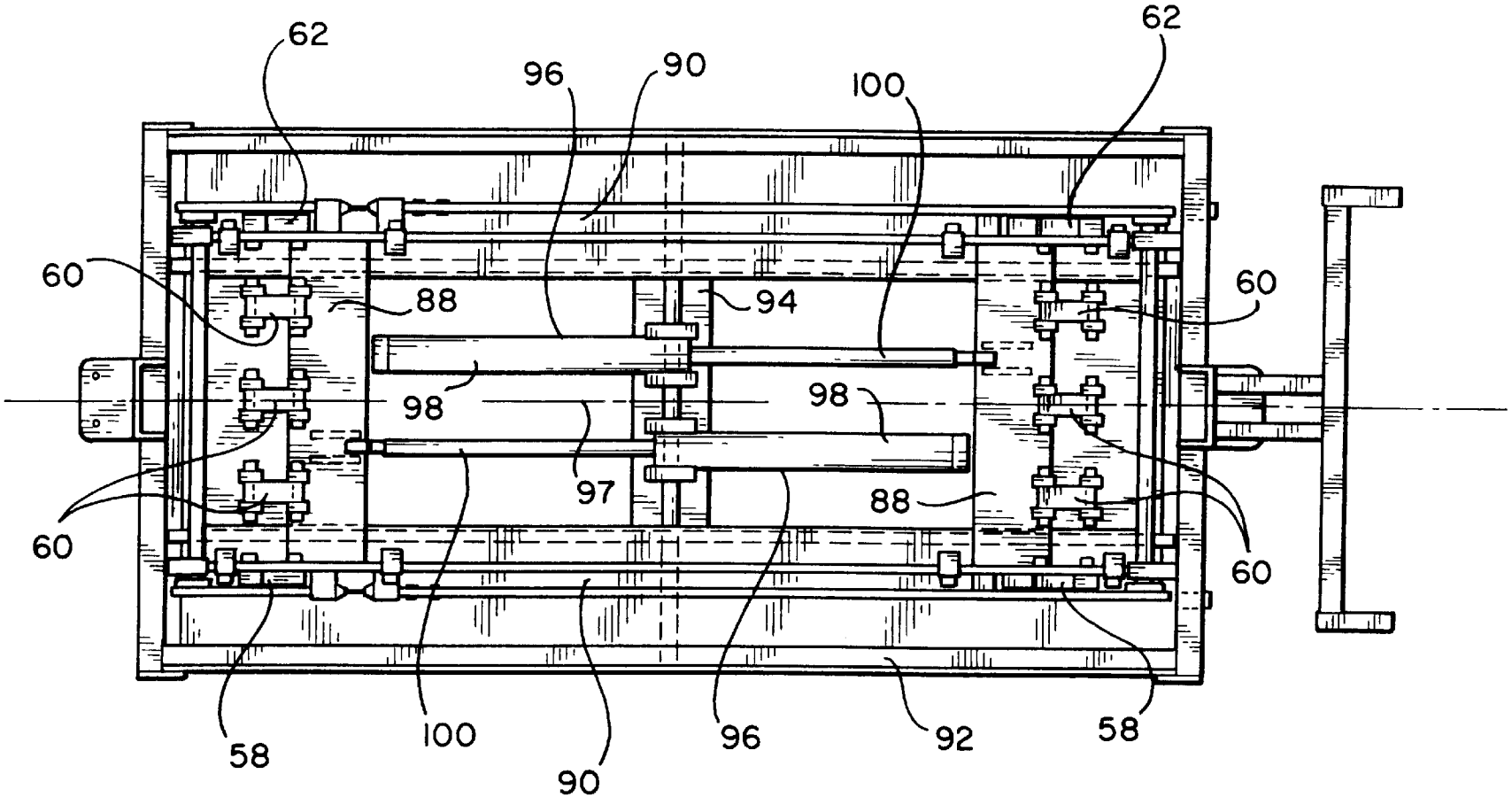
FIG. 9 is a top plan view of the compressor carrier, compressor carrier track or framework, and compressor carrier hydraulic drive assembly which is utilized within the insulation strapping machine or system of the present invention as disclosed within FIG. 1.

In order to actuate or move each one of the compressors 60 between their opened positions at which they are disposed relatively remote from the roller conveyor centerline 64 as shown in FIG. 6, to their closed positions at which they are disposed relatively closer to the roller conveyor centerline 64, each one of the compressors 60 is provided with a pair of dependent actuator bars 86 which are integral with the lower frame member 82 and which are transversely spaced from each other so as to in effect straddle the middle one of the three conveyor rollers 56 upon which the particular compressor 60 is slidably disposed. The actuator bars 86,86 extend downwardly so as to extend between adjacent ones of the conveyor rollers 56 and to extend below the surface of the roller conveyor 55 as defined by the individual conveyor rollers 56, and are adapted to be fixedly connected, such as, for example, by means of suitable bolt fasteners, to a pair of longitudinally spaced compressor carriers 88,88 which are best seen as illustrated in FIG. 9.

The carriers 88,88 are adapted to be slidably mounted upon a pair of transversely spaced, longitudinally extending track members 90,90 which form part of a track assembly or framework 92, and a longitudinally central weldment 94 fixedly interconnects oppositely disposed longitudinally central portions of each track member 90,90. A pair of hydraulic cylinder assemblies 96,96 are operatively connected between the weldment 94 and the compressor carriers 88,88 so as to provide actuation of the compressor carriers 88,88, and therefore, the compressors 58–60, as desired in connection with the performance of a package, article, or material strapping or packaging operation as will be described hereinafter. It is noted that the hydraulic cylinder assemblies 96,96 are disposed upon opposite sides of, and are transversely offset from, the longitudinal centerline 97 of the track assembly or framework 92.

More particularly, it is seen that each one of hydraulic cylinder assemblies 96,96 is seen to comprise a hydraulic cylinder 98 having a piston rod 100 operatively associated therewith. The rod end of each hydraulic cylinder 98 is fixedly attached to the weldment 94 while the free end of each piston rod 100 is fixedly attached to a respective one of the compressor carriers 88. The hydraulic cylinder assemblies 96,96 are also noted as being oriented in opposite senses, that is, one of the hydraulic cylinders 98 projects longitudinally to the right of the weldment 94, as viewed in FIG. 9, while the other one of the hydraulic cylinders 98 projects longitudinally to the left of the weldment 94, and similarly for the piston rods 100,100. In this manner, when the hydraulic cylinder assemblies 96,96 are actuated whereby the piston rods 100,100 are simultaneously extended or projected out from their respective hydraulic cylinders 98,98, the compressor carriers 88,88, and therefore the compressors 58–62 attached thereto, will be moved away from each other, whereas conversely, when the hydraulic cylinder assemblies 96,96 are actuated whereby the piston rods 100,100 are simultaneously contracted or drawn into their respective hydraulic cylinders 98,98, the compressor carriers 88,88, and therefore the compressors 58–62 attached thereto, will be moved toward each other.

It is to be lastly noted that, with respect to the compressors 58–62, all of the compressors 58–62 have substantially the same identical structure, so as to be capable of the same movement upon the roller conveyors 56, and to be capable of being connected to the compressor carriers 88,88 so as to be actuated by the hydraulic cylinder assemblies 96,96, with the exception that the compressors 58,58,62,62 in effect comprise right-hand or left-hand compressors depending upon their relative disposition within the compressor array as shown in FIG. 6. Each of the compressors 58, 58,62,62 comprises only one upper section 74 and one corresponding lower section 76, and such upper and lower sections 74,76 are disposed upon one side of the coil spring assembly 78 so as to therefore form, in effect, either a right-hand compressor or left-hand compressor. The left-hand or right-hand compressors 58,58,62,62 will therefore be disposed within the compressor array shown in FIG. 6 such that the compressor sections 74,76 are disposed toward the exterior of the compressor array while the coil spring assemblies are disposed toward the interior of the compressor array. In a similar manner, each one of such left-hand or right-hand compressors 58,58,62,62 only comprises a single carrier actuator bar 86 depending downwardly from the lower frame member 82. This structure of the compressors 58,58, 62,62 enables all of the compressors to be spatially accommodated within the strapping or packaging station 12 without requiring the strapping or packaging station 12 to be increased any further in size.

Referring again to FIG. 6, in accordance with a unique feature of the present invention, and at a location disposed adjacent to the exit side of the roller conveyor assembly 55, a movable section 102, which has a non-powered roller conveyor member 101 mounted thereon, is provided within the roller conveyor assembly 55 in lieu of one of the conveyor rollers 56. More particularly, the movable section 102 can be moved upwardly so as to be disposed or projected above the surface or level of the roller conveyor 55 and thereby effectively form a package stop assembly, as will be more fully discussed hereinafter, or can be moved downwardly to its normal position or state so as to in effect be a part of or incorporated within the roller conveyor assembly 55. Opposite longitudinal ends of the package stop assembly 102 are mounted upon fixed support or framework assemblies 104, 104, and the upper surface portions of the fixed support or framework assemblies 104,104 are disposed at an elevation or level just below the upper surface level of the roller conveyor assembly 55 so as not to interfere with the function of the roller conveyor assembly 55 with respect to the conveyance of packages, articles, or materials to be discharged from the strapping or packaging station 12.

Figure 5B:
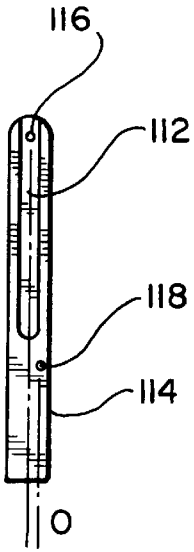
FIG. 5*b* is a front elevation view of the upper frame weldment member utilized within the package stop subassembly or subsystem disclosed within FIG. 4 for mounting the package stop roller member so as to achieve the arcuate inward movement of the package stop roller member as the package stop roller member is translated upwardly from its lowered position to its raised position.
Figure 4:
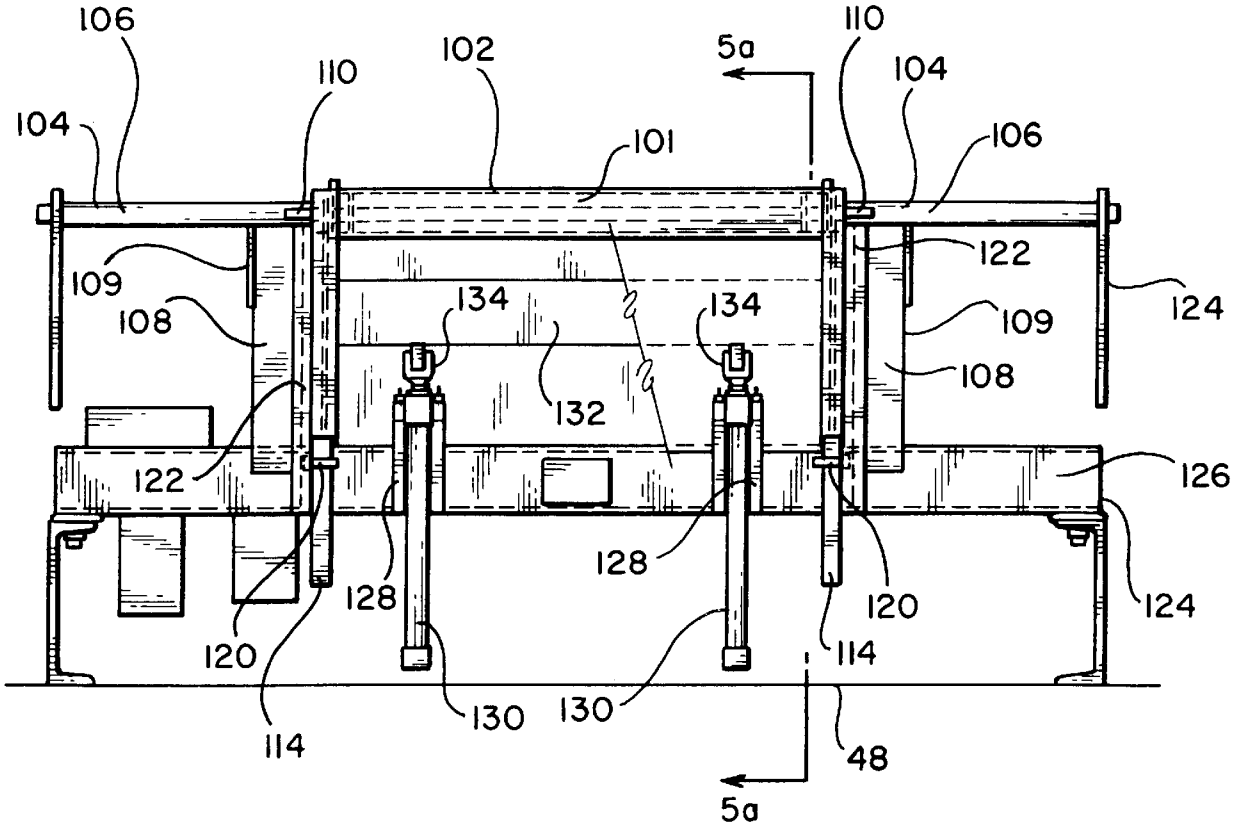
FIG. 4 is a partial side elevation view of the insulation strapping machine or system disclosed within FIG. 3 showing more particularly the package stop subassembly or subsystem and the hydraulic control members thereof which reciprocatingly control the disposition of the package stop member between its fully elevated and fully lowered positions.

With additional reference being made to FIGS. 4, 5*a*, and 5*b*, the actuation system for the package stop assembly 102 will now be described. Each one of the fixed support or framework assemblies 104 is seen to comprise a horizontally disposed support bar or frame member 106, and a vertically dependent support bar or frame member 108 which is integrally connected to the longitudinally inner end portion of the horizontally disposed support bar or frame member 106 such that the frame members 106 and 108 together form a lower frame member 109. An upper cam follower 110 is fixedly disposed within the longitudinally inner upper end portion of each lower frame member 109, and the upper cam follower 110 is adapted to be disposed within and thereby operatively cooperate with a vertical groove 112 defined within a vertically movable upper frame member 114, as best seen in FIG. 5*b*, upon which each opposite end of the non-powered conveyor roller 101 is mounted as also seen in FIG. 4. Each upper frame member 114 is provided with a first aperture 116 within which the corresponding end of the non-powered conveyor roller 101 is mounted, and a second aperture 118 within which a lower cam follower 120 is disposed for projection into and operative cooperation with a vertical groove 122 defined within the lower frame member 109.

When the package stop assembly 102 is disposed at its lowered position as illustrated in FIG. 4, the axis of the non-powered conveyor roller 101 and the axes of the upper cam followers 110,110 are coaxial with respect to each other. Consequently, it can be appreciated that the axes of the upper cam followers 110,110 and the lower cam followers 120,120, as defined, in effect, by means of the apertures 116 and 118 of the upper frame member 114 as shown in FIG. 5*b*, are offset or transversely spaced from each other by means of a space or gap O. This space or gap O remains constant throughout the vertical movements of the upper frame members 114,114, relative to the lower frame members 109, 109, as the package stop assembly 102 is moved between its raised and lowered positions due to the aforenoted operative cooperation between the upper cam followers 110, 110 of the lower frame members 109,109 and the vertical grooves 112,112 of the upper frame members 114,114, and the lower cam followers 120,120 of the upper frame members 114, 114 and the vertical grooves 122,122 of the lower frame members 109,109 so as to cause the package stop assembly 102 to move to its desired position in order to serve its purpose in connection with the operation of the insulation strapping machine of the present invention.

Figure 5A:
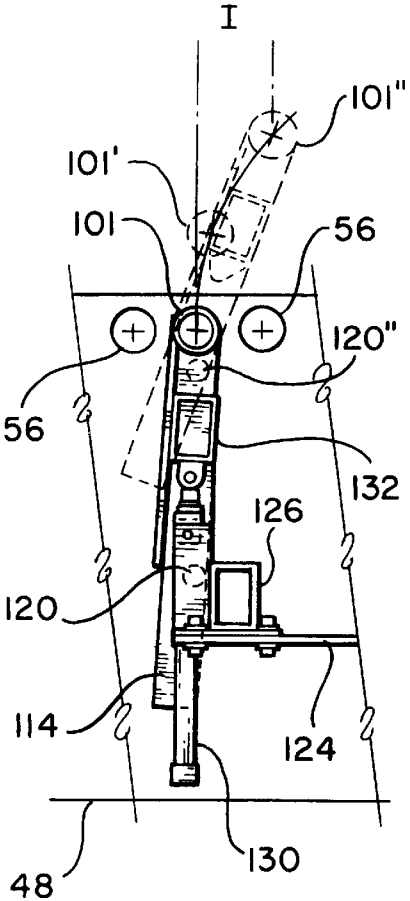
FIG. 5*a* is a partial end elevation view of the package stop subassembly or subsystem disclosed within FIG. 4 showing the disposition of the package stop member between its fully elevated and fully lowered positions.

More particularly, as can be seen from FIG. 5*a*, when the package stop assembly 102 is moved from its lowered position, wherein the non-powered conveyor roller is denoted by its reference character 101 and the lower cam followers are denoted by the reference character 120, to one of its raised positions, wherein the non-powered conveyor roller is alternatively denoted at 101' or 101" and the lower cam followers are denoted by the reference character 120", the previously noted constantly maintained offset disposition O defined between the lower cam followers 120,120 and the upper cam followers 110,110 causes the package stop assembly 102 to be tilted or inclined transversely whereby the non-powered conveyor roller 101 is in effect moved in a substantially arcuate manner and is ultimately disposed at the position noted at 101" which is located a distance I, of approximately 4.5 inches, inwardly with respect to the strapping or packaging station 12 and with respect to the original downward position of the non-powered conveyor roller as noted at the position 101. This inward movement of the package stop assembly conveyor roller 101 permits package, article, or material loads of different length dimensions to be automatically centered within the strapping or packaging station 12 as will be more fully appreciated hereinafter when the automatic controls of the insulation strapping machine of the present invention are more fully discussed hereinafter.

In order to actuate or move the package stop assembly 102 between its lowered and raised positions, the longitudinally outer end portion of each horizontally disposed support bar or frame member 106 is fixedly attached to an upper portion of the machine frame 124, and the lower end portion of each vertically disposed support bar or frame member 108 is fixedly secured to a horizontally disposed, longitudinally extending box beam member 126 which has opposite end portions thereof likewise affixed to lower portions of the machine frame 124. Longitudinally spaced central portions of the horizontally disposed box beam member 126 are provided with vertically disposed, longitudinally spaced upstanding guides 128,128 within which are fixedly housed a pair of hydraulic cylinders 130,130 for movably actuating the package stop assembly 102. A longitudinally extending cross-bar 132, having a box-beam structure similar to that of box beam member 126, interconnects the longitudinally spaced, vertically disposed upper frame members 114, 114, and piston rods 134,134 of the hydraulic cylinders 130, 130 are connected to the cross-bar 132. Obviously, actuation of the hydraulic cylinders 130,130 causes extension of the respective piston rods 134,134 which elevate the package stop assembly 102, and in particular, the non-powered conveyor roller 101, through means of the cross-bar 132 and the upper frame members 114,114 so as to achieve movement of the package stop assembly 102, and in particular, the non-powered roller 101, as shown in FIG. 5*a*.

Figure 10:
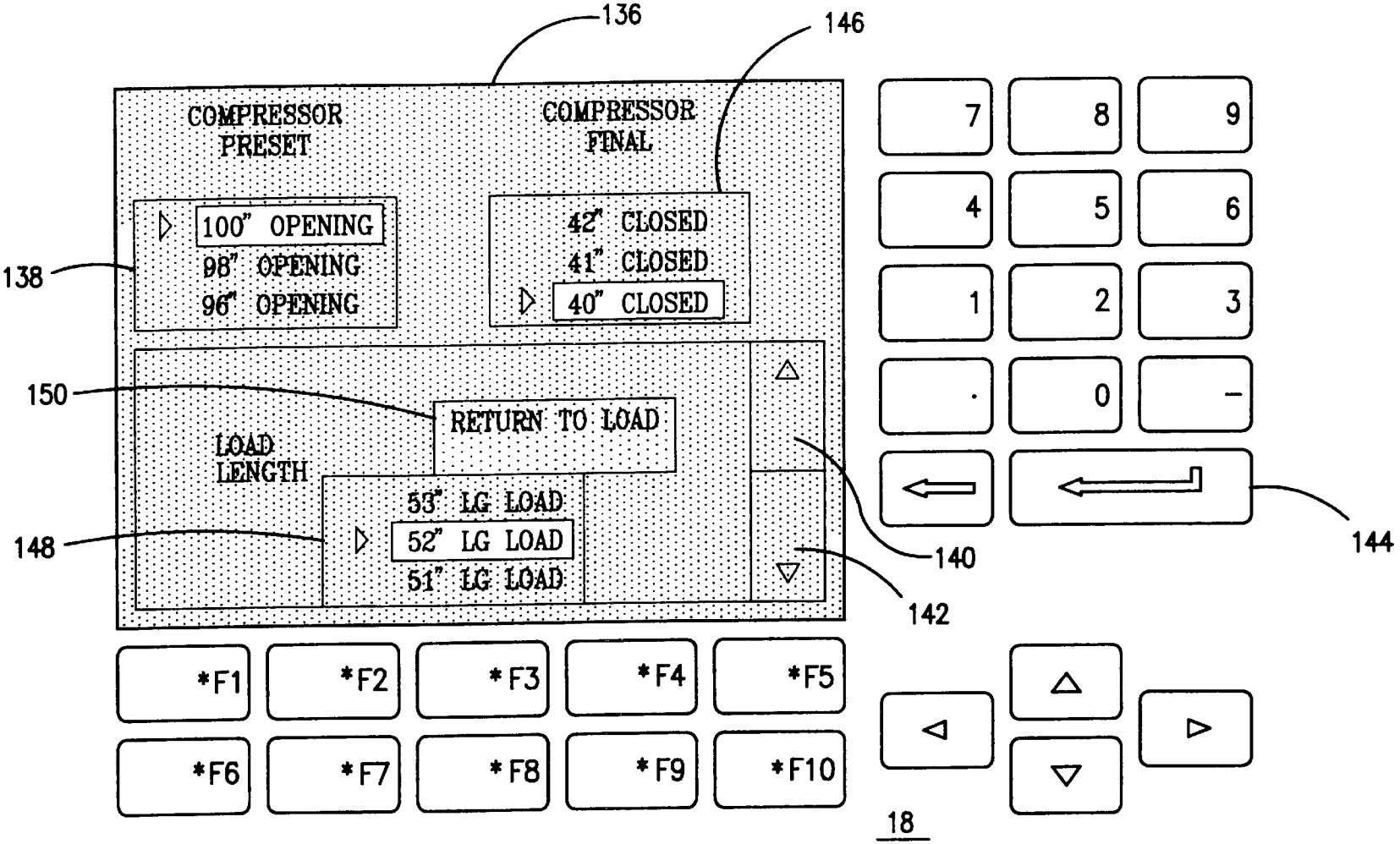
FIG. 10 is a schematic diagram of a load settings screen which is viewable upon the machine or system operator console and employed in conjunction with the operation of the insulation strapping machine or system of the present invention as disclosed within FIG. 1 so as to input various control data into the machine system in connection with the controlled positioning of the various operative components of the insulation strapping machine of the present invention.
Figure 11:
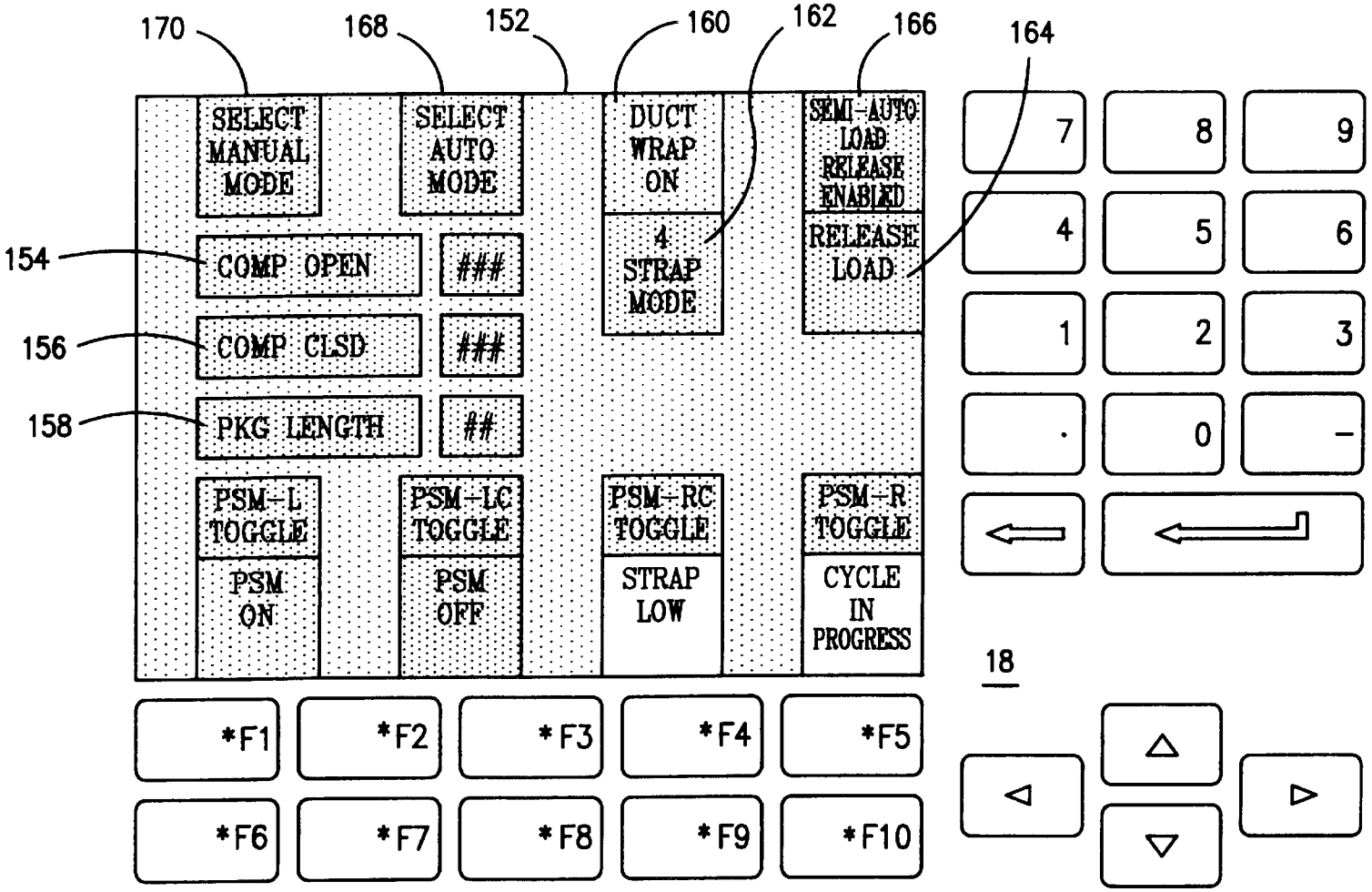
FIG. 11 is a schematic diagram similar to that of FIG. 10 showing, however, an automatic screen which is also viewable upon the machine or system operator console and employed in conjunction with the operation of the insulation strapping machine or system of the present invention as disclosed within FIG. 1 so as to automatically control the various operative components of the insulation strapping machine of the present invention.
Figure 12:
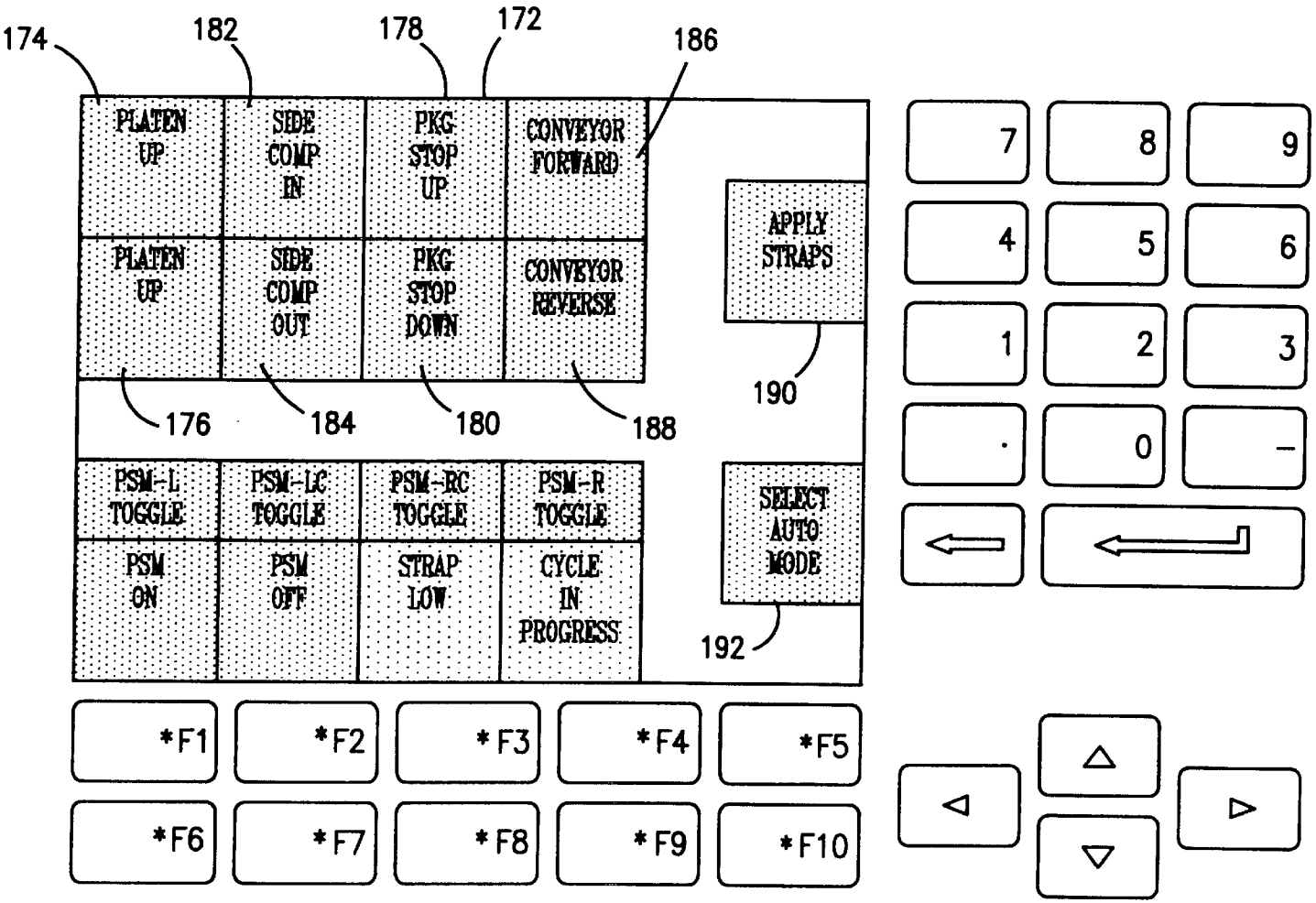
FIG. 12 is a schematic diagram similar to that of FIGS. 10 and 11 showing, however, a manual screen which is also viewable upon the machine or system operator console and employed in conjunction with the operation of the insulation strapping machine or system of the present invention as disclosed within FIG. 1 so as to manually control the various operative components of the insulation strapping machine of the present invention.

With reference being made to FIGS. 10–12 of the drawings, control features unique to the operation of the present invention will now be described. FIG. 10 is a schematic diagram of a load settings screen 136 which can be made to appear upon the operator console 18 and wherein various parameters, important to the proper operation of the insulation strapping machine 10 or 210 of the present invention, may be inputted into the machine's system whereby the various operative components of the machine 10 or 210 are disposed at predetermined initial positions and/or final positions as is operatively desirable. For example, it is important to initially dispose the longitudinally movable compressors 58–62 at predetermined opened positions with respect to each other so as to facilitate the insertion or introduction therebetween of the articles, packages, or materials to be strapped or packaged, as well as the subsequent strapping or packaging of the articles, packages, or materials. The compressors 58–62 should not, therefore, be disposed at an opened position which is, in effect, too small so as to prevent the insertion or introduction of the particular articles, packages, or materials into the space defined therebetween, however, such opened expanse or dimension should likewise not be too large because certain articles, packages, or materials need to be initially properly confined between the compressors 58–62 so as to be disposed in a proper orientation prior to commencement of the compression cycle of the machine and the subsequent strapping or packaging operation to be performed upon the articles, packages, or materials.

Accordingly, it is seen that the load settings screen 136 has a section entitled COMPRESSOR PRESET wherein several preset dimensions characteristic of the extent to which the compressors 58–62 can be initially opened may be pre-set into the system. In particular, the range to which the compressors 58–62 can be initially preset to their opened extent comprises seventy-four to one-hundred inches as defined between opposed ones of the compressors 58–62, and the particular opened dimension is achieved by touching the window display section 138 of the load settings screen 136 which therefore activates such section 138 of the screen 136. Using the UP and DOWN arrow control buttons 140,142 of the screen 136, the particular dimension to which the compressors 58–62 are to be initially opened can be made to appear upon the window display section 138 of the screen 136 in a scrolled down or scrolled up manner in two inch increments, and when the particular dimension in fact appears upon the window display 138, the same is highlighted by means of the white bordered region of the window display 138 as well as the white arrow adjacent to such white bordered region of the window display 138. In order to enter such dimension into the machine's memory and activation system, an ENTER button 144 is then depressed. This preset dimension of the compressors 58–62 will then be attained when the strapping or packaging operational cycle is commenced by suitable control of the compressor hydraulic control cylinder assemblies 96,96. Similar dimensional inputs may be achieved, in connection with the final opened extent to which the compressors 58–62 may be moved so as to achieve predetermined degrees or amounts of compression or compaction in connection with particular article, package, or material loads, by activating the COMPRESSOR FINAL window display section 146 of the screen 136. The final dimension to which the compressors 58–62 will be moved is within the range of thirty to fifty-two inches, and such dimension may be altered or adjusted by means of scrolling up or scrolling down in one-inch increments using the UP and DOWN control arrow buttons 140,142. The actual adjustable dimension to which the compressors 58–62 are actually moved is of course again controlled by means of the hydraulic cylinder assemblies 96,96.

Still further, the insulation strapping machine of the present invention can also accommodate articles, packages, or materials of different lengths and can effectively longitudinally center such articles, packages, or materials within the strapping or packaging station 12 such that the strapping or packaging members 54 are properly positioned upon and disposed around such articles, packages, or materials. Accordingly, the load settings screen 136 further comprises a LOAD LENGTH section which comprises a window display section 148 wherein different load length dimensions are displayed in one-inch increments, the range of the load length dimensions being variable between forty-five and fifty-three inches. Inputting a particular length dimension corresponding to the length of the particular article, package, or material load to be strapped or packaged serves to adjust the disposition of the package stop assembly 102 by means of the hydraulic control cylinders 130,130.

It is further noted in connection with the operator console 18 that ten function buttons F1–F10 are provided upon the console 18, and these ten function buttons F1–F10 can be utilized by depressing individual ones of such buttons F1–F10 so as to input different sets or combinations of the preset dimensions relating to the compressors 58–62 and the package stop assembly 102 into the machine's computer memory once the different dimensional parameters have been individually entered or selected. By subsequently depressing the particular function button F1–F10, that particular set or combination of dimensional parameters or values can be readily recalled from the machine memory whereby the individual dimensions do not have to be re-entered individually into the machine memory.

It is still further noted that in connection with the load settings screen 136, there is also a display button or window 150 entitled RETURN TO AUTO whereby depressing the same changes the display of the screen portion of the operator console 18 to another screen called the automatic screen 152 which is illustrated in FIG. 11. In connection with the automatic screen 152, it is of course noted from FIG. 11 that only the screen 152 per se has changed, the remainder of the operator console 18 being the same as in connection with the load settings screen 136 of FIG. 10. Accordingly, in order to retrieve or recall particular dimensional settings of the compressors 58–62 and the package stop assembly 102 from the machine computer memory, the particular one of the function keys or buttons F1–F10 may be depressed. In addition, it is noted that the automatic screen 152 has displays 154,156,158 which respectively display the particular dimensions corresponding to the compressor opened position, the compressor closed position, and the package length dimension which were preset data entered upon the load settings screen 136 as noted hereinbefore.

Still further, the automatic screen 152 also comprises a DUCT WRAP ON control button 160 which when depressed or touched serves to effectively tell the machine that duct wrap material is being strapped or packaged at the strapping or packaging station 12 whereby the platen 22 is controlled by means of the platen hydraulic cylinder assemblies 32,34 in such a manner that the platen 22 is lowered to an elevation level of approximately four inches above the top of the duct wrap material or load. The hydraulic cylinder assemblies 32,34 are appropriately controlled in this manner by means of proximity switches, not shown, disposed upon the machine framework 124. The reason that the platen 22 is controlled in such a manner, that is, the platen 22 is lowered to an elevation such that a space of approximately four inches is permitted to remain above the duct wrap load or material to be compressed and strapped or packaged, is that the compression and strapping or packaging operations of duct wrap material results in substantial vertical growth of the duct wrap material which must be accommodated so as to permit the strapping members 54 to properly strap, bind, or package the duct wrap material without experiencing failure.

On the other hand, if substantial compaction of the duct wrap material is in fact desired or required, the machine of the present invention can in fact accommodate such additional compaction of such material with its enhanced or increased density characteristics. In accordance with this mode of operation, the DUCT WRAP ON control button 160 is not depressed and the 4 STRAP MODE control button 162 is touched or depressed whereby the aforenoted proximity switch detectors, not shown, are effectively disabled, and an electric eye sensor system, also not shown, mounted upon the platen 22 detects the upper surface of the article, package, or material and controls the platen hydraulic cylinder assemblies 32,34 such that the movement of the platen is halted so as to permit the platen 22 to abut the top of the article, package, or material. Consequently, no growth of the load will permitted, whereby as a result of the compaction or compression of the package, article, or material load, substantial forces will be generated by the compressed or compacted load and impressed upon the strapping members 54. Therefore, in accordance with this mode of operation, the strapping heads 50 will undergo an additional strapping cycle whereby an additional four strapping members 54 will be disposed around the already strapped or packaged load such that failure of the strapping members is effectively prevented. Still further, if, in lieu of strapping or packaging duct wrap material, it is desired to strap or package standard insulation material, which may in fact be compressed or compacted to a greater extent or density than duct wrap material, then again, the DUCT WRAP ON control button 160 is not depressed or touched, and neither is the 4 STRAP MODE control button 162. As a result, the platen 22 will be moved downwardly so as to abut the top of the package, article, or material load, and only four strapping members 54 will be affixed around the package, article, or material load.

Other important control buttons incorporated within the automatic screen 152 is the RELEASE LOAD control button 164 which when pushed, depressed, or touched initiates operation of the machine 10 or 210 in a continuous cycle automatic mode, whereas when the SEMI-AUTO LOAD RELEASE ENABLED control button 166 is touched, pushed, or depressed, the various machine operations comprising only a single operative cycle, such as, for example, infeed of the load by the infeed or entry conveyor 14 and the roller conveyor assembly 55, actuation of the package stop assembly 102, actuation of the platen 22 and the compressors 58–62, actuation of the strapping heads 50, retraction of the platen 22 and the compressors 58–62, and actuation of the roller conveyor assembly 55 and the exit or discharge conveyor 16, is initiated. Still further, automatic screen 152 also includes a SELECT AUTO SETUP control button 168 which permits the operator to return to the load settings screen 136 of FIG. 10, and a SELECT MANUAL MODE control button 170 which permits the operator to change display screens and go to the manual screen 172 illustrated in FIG. 12.

As illustrated in FIG. 12, the manual screen 172 is essentially self-explanatory. More particularly, PLATEN UP and PLATEN DOWN control buttons 174 and 176 respectively permit the operator to manually control the upward and downward movements of the platen 22, and similarly for the PKG STOP UP and PKG STOP DOWN control buttons 178 and 180 which permit the operator to control the upward and downward movements of the package stop assembly 102. Still further, similar operator control of the compressors 58–62 is achieved by means of the SIDE COMP IN and SIDE COMP OUT control buttons 182 and 184, and likewise in connection with the CONVEYOR FORWARD and CONVEYOR REVERSE control buttons 186 and 188. It is to be noted that unlike the automatic preset or predetermined movements of the platen 22, the compressors 58–62, and the package stop assembly 102 as may be achieved by means of the aforenoted operation of the load settings screen 136 and the automatic screen 152, manipulation or actuation of the various control buttons 174–188 simply achieve the particular movements of the particular machine components only so long as the control buttons 174–188 are respectively pushed, touched, or depressed. An additional operator control button labelled APPLY STRAPS is denoted at 190, and as a result of the depression, touching, or pushing of such control button, the strapping heads 50 are activated so as to initiate a single strapping cycle. Accordingly, further pushing, touching, or depression of the control button 190 results in additional strapping cycles being performed whereby multiple strapping members 54 may be applied at the same locations or positions upon a particular article, package, or material load disposed at the strapping or packaging station. Lastly, the control button entitled SELECT AUTO MODE and designated by reference character 192 enables the operator to change display screens and access the automatic screen 152 as disclosed in FIG. 11.

Figure 13:
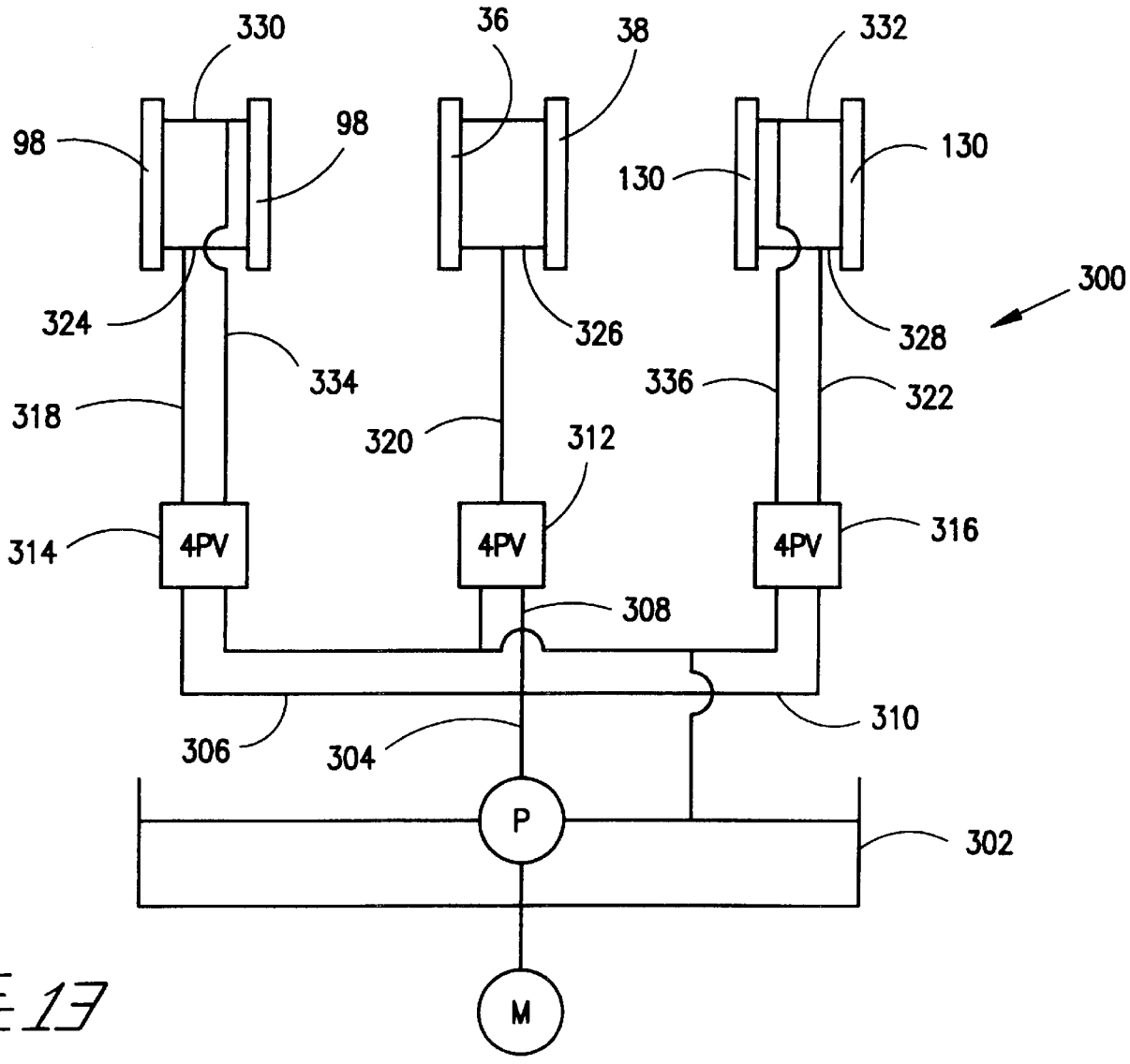
FIG. 13 is a schematic diagram of the hydraulic control system showing the pump and reservoir components fluidically connected to the various hydraulic cylinders, operatively associated with the longitudinally movable insulation article, material, or package compressors, the vertically movable platen, and the vertically movable package stop member, so as to operatively control such components so as to achieve the various dispositions of such components.

With reference lastly being made to FIG. 13, a simplified hydraulic control circuit for controlling the relative dispositions of the compressor hydraulic cylinder assemblies, the platen hydraulic cylinder assemblies, and the package stop hydraulic cylinder assemblies is disclosed and is generally indicated by the reference character 300. The hydraulic cylinders for actuating the compressors 58–62 are indicated at 98,98, the hydraulic cylinders for actuating the platen 22 are indicated at 36,38, and the hydraulic cylinders for actuating the package stop assembly 102 are indicated at 130,130. An adjustable pump P, driven by means of a motor M, is disposed within a reservoir or tank 302, and it is noted that the pump P can output pressure at 1800 psi. The fluidic output of the pump P is conducted into a first conduit 304 which is fluidically connected to conduits 306,308,310 so as to respectively supply hydraulic fluid to three four-position valves (4PV) 312,314,316 which have conventionally known structure. The output sides of the four-position valves 312,314,316 are fluidically connected to additional conduits 318,320,322 which serve to supply hydraulic fluid to the lower ends of each one of the hydraulic cylinder 98,98,36, 38,130,130 through means of fluid conduits 324,326,328 which fluidically interconnect the lower ends of the hydraulic cylinders 98,98,36,38,130, 130. In this manner, when each one of the four-position valves 312,314, 316 is disposed, for example, at a first predetermined position, hydraulic fluid is supplied to the lower ends of the hydraulic cylinders 98,98,36,38,130,130 so as to cause extension of their respective piston rods and thereby cause longitudinal separation or opening of the compressors 58–62, elevation of the platen 22, and upward movement of the package stop assembly 102.

It is further appreciated that the upper ends of the compressor hydraulic cylinders 98,98 are fluidically interconnected by means of a conduit 330, while the upper ends of the package stop assembly hydraulic cylinders 130,130 are similarly fluidically interconnected by means of a conduit 332. Conduit 330 is also fluidically connected to the four-position valve 314 by means of a conduit 334, while conduit 20 332 is similarly fluidically connected to the four-position valve 316 by means of a conduit 336. In this manner, when the four position valves 314 and 316 are operatively controlled so as to be moved to predetermined second positions, as is well-known in the art, hydraulic fluid is able to be supplied to the upper ends of the hydraulic cylinders 98,98 and to the upper ends of the hydraulic cylinders 130,130 so as to respectively move their piston rods downwardly whereby the compressors 58–62 are moved inwardly toward each other so as to achieve compression or compaction of the particular articles, packages, or materials disposed at the strapping or packaging station 12, and the package stop assembly 102 is lowered. It is noted that a separate fluid conduit is not necessarily provided for fluidically interconnecting the upper ends of the platen hydraulic cylinders 36,38 because when the four-position valve 312 is moved, for example, to its second predetermined position, the lower ends of the hydraulic cylinders 36,38 will be fluidically connected to the tank or reservoir 302 through means of the four-position valve 312 whereby the weight of the platen 22 will cause the piston rods of the hydraulic cylinders 36,38 to simply move downwardly under gravitational forces so as to permit the platen 22 to be lowered to a predetermined elevational position in accordance with the controlled operation of the four-position valve 312.

Thus, it may be seen or appreciated that the insulation strapping machine of the present invention has several unique structural and operational features incorporated therein so as to provide the strapping or packaging art with improved performance characteristics. It is additionally noted, for example, that as a result of fabricating the compressor hydraulic cylinders 98,98 with 3.25 inch diameter bores, and with the use of pump P outputting hydraulic pressure at 1800 psi, each one of the compressors 58–62 is able to generate 10,000 pounds of force which enables compression or compaction of articles, packages, or materials to a predetermined degree which has not been able to be heretofore accomplished in the art. It is also noted that the various structural components of the machine, for example, the machine frame, the article or package compressors, the compressor carriers, and the like, are also all fabricated from 4150RS (ASME resulferized) alloy steel so as to be capable of generating and transmitting the substantial forces attendant the operation of the various components of the machine. Still further, by providing the package stop assembly 102, and its attendant automatic control from the operator console 18, different sized package, article, or material loads can be automatically longitudinally centered with respect to the packaging or strapping station 12 such that the strapping or packaging members 54 can be properly secured around the material, package, or article loads at the proper symmetric positions thereof. The size of the machine package cavity is also able to be controlled or predetermined, and in addition, different types of articles, packages, or materials are able to be strapped or package in accordance with different strapping or packaging modes.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America is:

1.An insulation strapping machine for strapping articles, packages, and materials, comprising:

a roller conveyor assembly defending a strapping station and upon which an article to be strap is supportably dispose; a platen disposed above said roller conveyor assembly;

means operatively connected to said platen for vertically moving said platen toward and away from said roller conveyor assembly;

a plurality of compressor positioned along said roller conveyor assembly and comprising at least one pair of opposed compressor movably longitudinally across said roller conveyor assembly toward and away from each other an cooperating with said platen for defending cavity within which an article is able to be volumetrically compressed, by said at least one pair of opposed compressor when said at least one pair of opposed compressors are moved toward each other, such that the compressed article can be a trapped;

means for actuating each one of said plurality of compressors relative to and toward each other across said roller conveyor assembly such that said at least one pair of opposed compressors can together generate a compressive force sufficient to volumetrically compress the article disposed within said cavity defined between said platen, said roller conveyor assembly, and said plurality of compressors;

program means for inputting into said machine data indicative of the article dimensions and first initial and second final positions at which each one of said plurality of compressors is to be disposed in connection with an article compression operation and automatically controlling said means for actuating each one of said plurality of compressors wherein each one of said plurality of compressor is initially disposed at first predetermined position prior to commencement of a compression operation in response to said dimension data of the article to be strapped so as to permit an article having predetermined dimension to be properly accommodated within said cavity define between said platen, said roller conveyor assembly, and said plurality of compressors, and wherein each one of said plurality compressors is finally disposed and retained at a second predetermined position at the conclusion of said article compression operation so as to achieve proper volumetric compression of the article in preparation for the strapping of the compressed article; and strapping means for applying strapping members to the compressed article to be strapped and disposed within said cavity defined between said platen, said roller conveyor assembly, and said plurality of compressor.

2. The machine as set forth in claim 1, wherein:

said first initial position of each one of said plurality of compressors defines a longitudinal extent between oppositely disposed pairs of said plurality of compressors which is within the range of seventy-four to one hundred inches, and said second final position of each one of said plurality of compressors defines a longitudinal ex-tent between oppositely disposed pairs of said plurality of compressors which is within the range of thirty to fifty-two inches.

3. The machine as set forth in claim 2, further comprising:

a package stop operatively associated with said roller conveyor for abutting an article inserted into said strapping station; and program means for inputting into said machine data indicative of the longitudinal length dimension of an article to be strapped and for automatically controlling the disposition of said package stop in view of said longitudinal length dimension so as to longitudinally center the article to be strapped within said strapping station.

4. The machine as set forth in claim 3, wherein:

said package stop comprises a roller incorporated within said roller conveyor.

5. The machine as set forth in claim 4, wherein:

said package stop is movable between a first lowered position at which said package stop roller is incorporated within said roller conveyor, and a second elevated position at which said package stop roller abuts an article to be strapped at said strapping station so as to longitudinally center the article to be strapped at said strapping station.

6. The machine as set forth in claim 5, wherein:

said package stop is movable between a plurality of elevated positions such that said package stop roller can longitudinally center articles having length dimensions which are within the range of forty-five to fifty-three inches.

7. The machine as set forth in claim 4, further comprising:

actuating means for moving said package stop in a substantially arcuate manner so as to move said package stop roller inwardly with respect to said strapping station.

8. The machine as set forth in claim 7, wherein said actuating means comprises:

upper and lower relatively movable frame members;

grooves respectively defined within said upper and lower frame members; and at least one pair of cam followers respectively disposed upon said lower and upper frame members for respective cooperative movement within said grooves of said upper and lower frame members.

9. The machine as set forth in claim 8, wherein:

said upper and lower cam followers are offset with respect to each by means of a constant amount such that as said upper and lower frame members are moved relative to each other, said upper and lower frame members are caused to rotate with respect to each other so as to achieve said arcuate movement of said package stop roller.

10. The machine as set forth in claim 1, wherein:

said plurality of compressors comprises two sets of oppositely disposed paired compressors.

11. The machine as set forth in claim 10, wherein:

each one of said sets of oppositely disposed paired compressors comprises five laterally spaced compressors.

12. The machine as set forth in claim 10, wherein said means for actuating said plurality of compressors comprises;

a plurality of first hydraulic cylinder assemblies; and a hydraulic pump fluidically connected to said first hydraulic cylinder assemblies for conducting hydraulic fluid to said plurality of first hydraulic cylinder assemblies.

13. The machine as set forth in claim 12, wherein:

each one of said plurality of hydraulic cylinder assemblies comprises a hydraulic cylinder having a bore 3.25 inches in diameter; and said hydraulic pump has an output pressure of 1800 psi.

14. The machine as set forth in claim 12, further comprising:

at least one track member disposed beneath said roller conveyor;

a compressor carrier provided for each one of said two sets of oppositely disposed compressors wherein said compressor carriers are movably mounted upon said at least one track member;

a lower frame member of each one of said plurality of compressors has at least one arcuately-configured portion defined therein so as to permit each one of said plurality of compressors to be movable along an upper surface portion of at least one roller member of said roller conveyor;

at least one actuator bar depending downwardly from said lower frame member of each one of said plurality of compressors so as to be disposed between adjacent roller members of said roller conveyor for connection to one of said compressor carriers; and a support member fixedly disposed at a longitudinally central position with respect to said roller conveyor;

said plurality of first hydraulic cylinder assemblies having opposite ends thereof connected to said compressor carriers and said support member for moving said compressor carriers toward and away from each other when piston rod members of said first hydraulic cylinder assemblies are respectively contracted and extended.

15. The machine as set forth in claim 14, wherein:

said plurality of first hydraulic cylinder assemblies have their piston rod members oppositely oriented with respect to each other and with respect to said support member such that when piston rod members of said plurality of first hydraulic cylinder assemblies are simultaneously contracted and extended, said plurality of compressors are simultaneously moved toward and away from each other.

16. The machine as set forth in claim 1, wherein:

each one of said plurality of compressors comprises a vertically telescopic structure so as to cooperate with said platen in defining said cavity within which the article is to be compressed when said platen is moved to be predetermined position relative to said roller conveyor.

17. The machine as set forth in claim 12, wherein said means operatively connected to said platen for vertically moving said platen toward and away from said roller conveyor comprises:

a pair of frame members within which opposite ends of said platen are mounted; and a plurality of second hydraulic cylinder assemblies operatively connected to said pair of frame members.

18. The machine as set forth in claim 17, wherein:

said hydraulic pump is fluidically connected to said plurality of second hydraulic cylinder assemblies for conducting hydraulic fluid to said plurality of second hydraulic cylinder assemblies.

19. The machine as set forth in claim 12, further comprising:

a package stop operatively associated with said roller conveyor for movement between a first lowered position at which said package stop permits an article to be discharged from said roller conveyor, and a second elevated position at which said package stop abuts an article to be strapped at said strapping station so as to longitudinally center the article to be strapped at said strapping station in preparation for a strapping operation; and a plurality of third hydraulic cylinder assemblies operatively connected to said package stop for controlling said movement of said package stop between said first and second lowered and elevated positions.

20. The machine as set forth in claim 19, further comprising:

said hydraulic pump is fluidically connected to said plurality of third hydraulic cylinder assemblies for conducting hydraulic fluid to said plurality of third hydraulic cylinder assemblies.

21. The machine as set forth in claim 1, wherein said strapping means comprises:

a plurality of first horizontally disposed strapping chute members defined upon said platen;

a plurality of second vertically disposed strapping chute members interposed between adjacent ones of said plurality of compressors disposed within said two sets of oppositely disposed paired compressors; and a plurality of third horizontally disposed strapping chute members disposed beneath said roller conveyor, said first, second, and third strapping chute members together defining substantially continuous circuitous conduits disposed around the article to be strapped at the strapping station.

* * * * *